US011062599B2

(12) United States Patent
Ohe et al.

(10) Patent No.: US 11,062,599 B2
(45) Date of Patent: Jul. 13, 2021

(54) TRAFFIC MANAGEMENT SYSTEM, CONTROL METHOD, AND VEHICLE

(71) Applicant: TOYOTA JIDOSHA KABUSHIKI KAISHA, Toyota (JP)

(72) Inventors: Yoshihiro Ohe, Kawasaki (JP); Ayana Takeshita, Kasugai (JP); Shunsuke Tanimori, Susono (JP); Ryosuke Tanimura, Nisshin (JP); Yuhei Suzuki, Kariya (JP); Hiromitsu Fujii, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/727,209

(22) Filed: Dec. 26, 2019

(65) Prior Publication Data

US 2020/0250973 A1 Aug. 6, 2020

(30) Foreign Application Priority Data

Feb. 1, 2019 (JP) ..... JP2019-017368

(51) Int. Cl.

| | |
|---|---|
| ***G08G 1/015*** | (2006.01) |
| ***G08G 1/0965*** | (2006.01) |
| ***G08G 1/01*** | (2006.01) |
| ***G08G 1/0967*** | (2006.01) |
| ***G08G 1/127*** | (2006.01) |
| ***G08G 1/056*** | (2006.01) |

(52) U.S. Cl.

CPC ..... *G08G 1/0965* (2013.01); *G08G 1/015* (2013.01); *G08G 1/0112* (2013.01); *G08G 1/056* (2013.01); *G08G 1/096741* (2013.01); *G08G 1/096775* (2013.01); *G08G 1/127* (2013.01)

(58) Field of Classification Search

CPC ..... G08G 1/0965; G08G 1/0112; G08G 1/04; G08G 1/017; G08G 1/0175; G08G 1/205; G08G 1/20; G06K 9/00825

See application file for complete search history.

(56) References Cited

U.S. PATENT DOCUMENTS

| | | | | |
|---|---|---|---|---|
| 6,700,504 | B1 * | 3/2004 | Aslandogan | G08G 1/087 340/901 |
| 9,934,685 | B1 * | 4/2018 | Bernhardt | G08G 1/005 |
| 2007/0159354 | A1 * | 7/2007 | Rosenberg | G08G 1/0965 340/902 |
| 2013/0162824 | A1 * | 6/2013 | Sung | G01C 21/005 348/148 |

FOREIGN PATENT DOCUMENTS

| | | | |
|---|---|---|---|
| JP | 08-287394 | A | 11/1996 |

* cited by examiner

*Primary Examiner* — Benyam Haile
(74) *Attorney, Agent, or Firm* — Oblon, McClelland, Maier & Neustadt, L.L.P.

(57) ABSTRACT

In a traffic management system including a vehicle and a database, the vehicle transmits emergency vehicle information including position information of the vehicle to the database when an emergency vehicle is detected from an image which is captured by an imaging unit, and the database stores the emergency vehicle information transmitted from the vehicle. The traffic management system further includes an information processing device. The information processing device predicts a traveling route on which the emergency vehicle is to travel based on the emergency vehicle information stored in the database.

16 Claims, 8 Drawing Sheets

TRAFFIC MANAGEMENT SYSTEM, CONTROL METHOD, AND VEHICLE

INCORPORATION BY REFERENCE

The disclosure of Japanese Patent Application No. 2019-017368 filed on Feb. 1, 2019 including the specification, drawings and abstract is incorporated herein by reference in its entirety.

BACKGROUND

1. Technical Field

The disclosure relates to a traffic management system, a control method, and a vehicle and more particularly to a traffic management system, a control method, and a vehicle that can ascertain a position of an emergency vehicle.

2. Description of Related Art

An emergency vehicle needs to travel preferentially on a road in an emergency, and, for this purpose, nearby vehicles need to perform appropriate behavior such as stopping or withdrawing such that a traveling route can be secured for the emergency vehicle.

In the related art, an onboard navigation system in which vehicles traveling on a road communicate with each other to receive traveling data of other vehicles and to provide the traveling data to route guidance of a vehicle was proposed. Japanese Patent Application Publication No. 8-287394 (JP 8-287394 A) discloses that a navigation system receives traveling data of an emergency vehicle and provides information on approach of the emergency vehicle to a driver to call attention when an emergency vehicle approaches in a traveling direction of a host vehicle.

SUMMARY

The above-mentioned related art is based on the premise that traveling position information is received from an emergency vehicle, but when traveling position information cannot be acquired from an emergency vehicle, it is difficult to remotely ascertain a position of the emergency vehicle. Accordingly, there is concern that a driver will not be able to appropriately cope with approach of an emergency vehicle.

Accordingly, the disclosure provides a traffic management system, a control method, and a vehicle that can ascertain a position of an emergency vehicle even when traveling position information cannot be received from the emergency vehicle.

A traffic management system according to an aspect of the disclosure is a traffic management system including a vehicle and a database. The vehicle transmits emergency vehicle information including position information of the vehicle to the database when an emergency vehicle is detected from an image which is captured by an imaging unit. The database stores the emergency vehicle information transmitted from the vehicle.

A control method according to another aspect of the disclosure is a method of controlling a traffic management system including a vehicle and a database. The method includes: causing the vehicle to generate an image by imaging outside of a vehicle; causing the vehicle to transmit emergency vehicle information including position information of the vehicle to the database when an emergency vehicle is detected from the image; and causing the database to store the emergency vehicle information transmitted from the vehicle.

A vehicle according to still another aspect of the disclosure is a vehicle that is able to communicate with a database. The vehicle includes: an imaging unit configured to generate an image by imaging outside of the vehicle; a position information acquiring unit configured to acquire position information of the vehicle; a communication unit configured to communicate with the database; and a control unit configured to transmit emergency vehicle information including the position information of the vehicle to the database via the communication unit when an emergency vehicle is detected from the image.

With the traffic management system, the control method, and the vehicle according to the disclosure, it is possible to ascertain a position of an emergency vehicle even when traveling position information cannot be received from the emergency vehicle.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
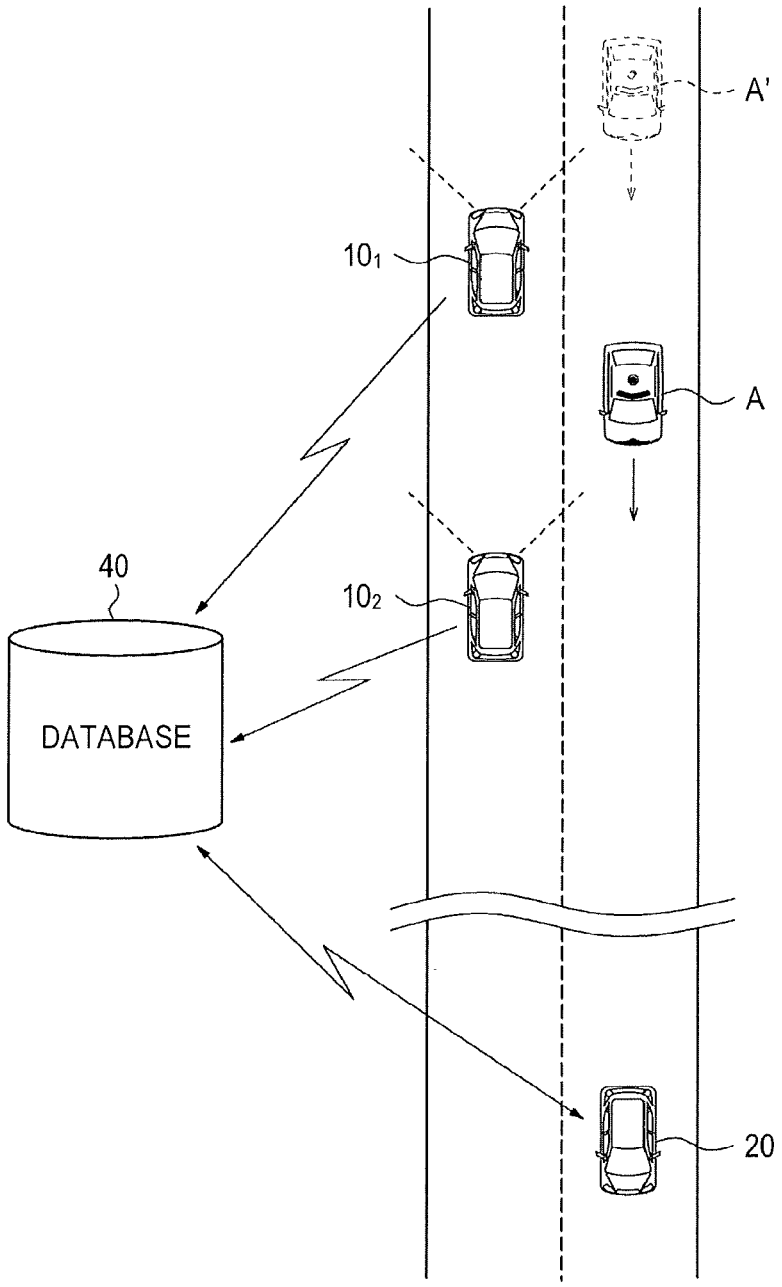
FIG. 1 is a diagram illustrating a basic operation of a traffic management system according to an embodiment.

Hereinafter, an embodiment of the disclosure will be described with reference to the accompanying drawings. In the drawings, the same reference signs refer to the same or equivalent elements.

Embodiment

FIG. 1 is a diagram illustrating a basic operation of a traffic management system according to an embodiment. The traffic management system includes at least a vehicle 10 and a database 40.

When an emergency vehicle (for example, an ambulance, a patrol car, or a fire truck) A (A') is found (detected) based on an image (which may be a moving image or a still image) which is acquired by an onboard camera or the like, a first vehicle 10 ($10_1$, $10_2$) transmits emergency vehicle information including position information of the host vehicle (the first vehicle) 10 to the database 40. Here, the position information of the host vehicle (the first vehicle) 10 at the time of acquisition of an image can be substantially considered as position information of an emergency vehicle at the time of acquisition of an image. Information such as a type of the emergency vehicle A and a traveling direction thereof (which is determined to be the opposite direction or the same direction based on the traveling direction of the host vehicle 10) can also be transmitted as emergency vehicle information to the database 40.

The database 40 stores the emergency vehicle information received from the first vehicle 10 along with time information. The database 40 can also store emergency vehicle information acquired from a plurality of first vehicles 10 ($10_1$, $10_2$).

A second vehicle 20 which is located in the traveling direction of the emergency vehicle A can ascertain position information of the emergency vehicle A (the position information of the vehicle which has found the emergency vehicle A) along with time information, by accessing the database 40. The speed and the traveling direction of the emergency vehicle A may also be estimated from the position information and the time information in which a plurality of first vehicles has found the emergency vehicle A. For example, caution information on an emergency vehicle indicating that the emergency vehicle A is approaching may be transmitted from the database 40 to the second vehicle 20. With this system, the second vehicle 20 can ascertain the position of the emergency vehicle A before the emergency vehicle A approaches the second vehicle 20.

Figure 2:
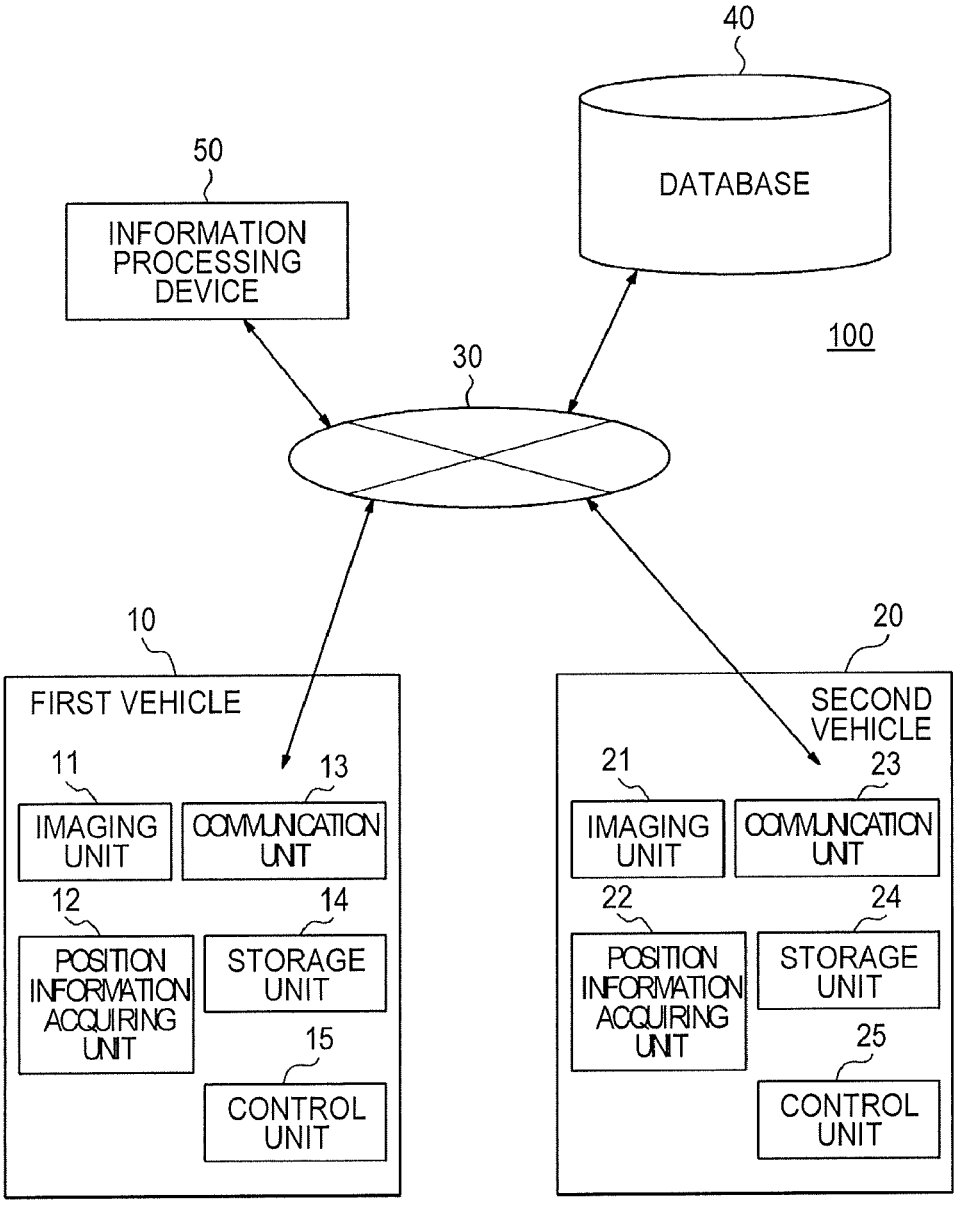
FIG. 2 is a diagram illustrating an example of a configuration of the traffic management system according to the embodiment.

FIG. 2 is a diagram illustrating an example of a configuration of a traffic management system 100 according to the embodiment of the disclosure. The traffic management system 100 includes at least a first vehicle 10 and a database 40. The traffic management system 100 may include an information processing device 50. The first vehicle 10, the database 40, and the information processing device 50 can communicate with each other via a network 30 including a mobile communication network and the Internet. The traffic management system 100 may be connected to a second vehicle 20 via the network 30.

The first vehicle 10 according to this embodiment analyzes images obtained by imaging the surroundings of the vehicle 10, and transmits information of an emergency vehicle (such as a type and a traveling direction of an emergency vehicle) along with the position information of the host vehicle to the database 40 as emergency vehicle information via the network 30 when an emergency vehicle is detected from the images. Emergency vehicle information may include the image from which the emergency vehicle has been detected. In FIG. 2, only one first vehicle 10 is illustrated for the purpose of simplification, but the number of first vehicles 10 may be two or more. Emergency vehicle information from two or more first vehicles 10 is transmitted to the database 40.

Even when no emergency vehicle is detected, the first vehicle 10 may transmit road image which is captured during traveling to the database 40.

The database 40 stores time information in correlation with the emergency vehicle information (such as a type and position information of an emergency vehicle) transmitted from the first vehicle 10. Time information may be added based on a time of reception by the database 40, but it is preferable that the first vehicle 10 transmit a time at which the image including the emergency vehicle has been captured along with the emergency vehicle information and this image-capturing time be used as the time information. The database 40 stores emergency vehicle information received from a plurality of first vehicles 10. The database 40 stores a road image captured by the first vehicle 10 or road information which is a result of analysis of the road image, which is preferably stored as detailed map information.

The database 40 may have an arbitrary configuration as long as it includes a communication module that performs communication via the network 30, a memory that stores information, and a processor that performs control.

The information processing device 50 accesses the database 40 via the network 30, analyzes emergency vehicle information stored in the database 40, and performs various processes. For example, the information processing device 50 may predict a traveling route on which the emergency vehicle A is traveling based on the emergency vehicle information stored in the database 40 and transmit caution information on an emergency vehicle to the second vehicle 20 which is located on the predicted traveling route of the emergency vehicle A. The information processing device 50 is constituted, for example, by one or more server devices which are connected to the network 30.

The information processing device 50 may have an arbitrary configuration as long as it includes a communication module that performs communication via the network 30, a memory that stores information, and a processor that analyzes information stored in the database 40 and performs various processes.

The database 40 and the information processing device 50 may be formed integrally as one body.

The configurations of the first vehicle 10 and the second vehicle 20 will be described below. The first vehicle 10 and the second vehicle 20 are basically vehicles having the same configuration. The first vehicle 10 is defined as a vehicle that transmits emergency vehicle information to the database 40, and the second vehicle 20 is defined as a vehicle that receives caution information on an emergency vehicle from the database 40 or the information processing device 50.

The first vehicle 10 includes an imaging unit 11, a position information acquiring unit 12, a communication unit 13, a storage unit 14, and a control unit 15.

The imaging unit 11 is a so-called onboard camera and includes a camera that captures an image in front of (outside) the vehicle herein. The onboard camera may be a monocular camera or a stereoscopic camera. The imaging unit 11 is, for example, a drive recorder that generates continuous images in front of the vehicle during driving and during stopping and records the generated images in the storage unit 14. In this embodiment, the imaging unit 11 generates an image including an emergency vehicle and/or an image of a road.

The position information acquiring unit 12 includes one or more receivers corresponding to an arbitrary satellite positioning system. For example, the position information acquiring unit 12 may include a global positioning system (GPS) receiver. The position information acquiring unit 12 detects position information of the host vehicle. Preferably, the position information acquiring unit 12 acquires information of a direction in which the vehicle is moving ahead along with a position at which the host vehicle is traveling (or stopping), for example, which can be acquired by a geomagnetic sensor or a gyro sensor. In this embodiment, preferably, the position information acquiring unit 12 transmits the position information of the host vehicle to the database 40 at predetermined times (for example, periodically), and the information processing device 50 ascertains the position information of the vehicles 10 (the vehicles 20) with reference to the database 40.

The communication unit 13 includes a communication module that performs communication between the host vehicle 10 and the database 40 and/or the information processing device 50. The communication unit 13 may include a communication module that is connected to the network 30 or a communication module that supports a mobile communication standard such as 4G (4th Generation) or 5G (5th Generation). For example, an onboard communication device such as a data communication module (DCM) which is mounted in the first vehicle 10 may serve as the communication unit 13. In this embodiment, the communication unit 13 can transmit emergency vehicle information to the database 40 and receive a variety of information from the database 40 and/or the information processing device 50.

The storage unit 14 is a device that records and stores a variety of information and includes one or more memories. A "memory" is, for example, a semiconductor memory, a magnetic memory, or an optical memory but is not limited thereto. Each memory which is included in the storage unit 14 may serve as, for example, a main storage device, an auxiliary storage device, or a cache storage device. The storage unit 14 stores arbitrary information associated with the operation of the first vehicle 10 For example, the storage unit 14 stores an image generated by the imaging unit 11 and position information acquired by the position information acquiring unit 12 in correlation with time information at the time of generation of the image. The storage unit 14 also stores information of a result of analysis and processing of the generated image by the control unit 15. The storage unit 14 stores a vehicle control program of the host vehicle and stores a variety of information associated with operation control of the vehicle.

The control unit 15 includes one or more processors. Each "processor" may be a general-purpose processor or a dedicated processor specialized in a specific process. For example, an electronic control unit (ECU) which is mounted in the first vehicle 10 may serve as the control unit 15. The control unit 15 controls the whole operation of the first vehicle 10. For example, the control unit 15 controls the imaging unit 11, the position information acquiring unit 12, the communication unit 13, and the storage unit 14 and also controls all traveling operations of the host vehicle. In this embodiment, the control unit 15 detects an emergency vehicle from a forward vehicle-outside image generated by the imaging unit 11. Specifically, the control unit 15 can perform an image analysis process and analyze a type and a traveling direction of an emergency vehicle.

Detection of an emergency vehicle can be performed by general image processing. For example, image patterns such as shapes and colors of various emergency vehicles are registered in the storage unit 14, and the control unit 15 compares an image pattern of a traveling vehicle in an image acquired by the imaging unit 11 with the registered image patterns of emergency vehicles. A type of an emergency vehicle can be detected depending on whether both image patterns match each other. The image processing is not limited to pattern matching, and, for example, an arbitrary image recognition algorithm such as feature point extraction or machine learning can be employed. An emergency vehicle that travels to a destination in an emergency and an emergency vehicle that has ended a service and is returning home can be distinguished, for example, depending on whether a red warning lamp is flickering.

The control unit 15 may analyze a traveling direction of a detected emergency vehicle based on information such as a traveling direction of the host vehicle and whether the emergency vehicle is an oncoming vehicle or an overtaking vehicle.

The second vehicle 20 includes an imaging unit 21, a position information acquiring unit 22, a communication unit 23, a storage unit 24, and a control unit 25. The configurations of the constituent units of the second vehicle 20 are substantially the same as the configurations of the corresponding constituent units of the first vehicle 10 and thus description thereof will not be repeated.

The second vehicle 20 is a vehicle that receives caution information on an emergency vehicle from the traffic management system 100 as described above. That is, when an emergency vehicle approaches, the communication unit 23 of the second vehicle 20 receives caution information on an emergency vehicle including information such as a current position and a traveling direction of an emergency vehicle and information such as a place which is suitable for withdrawal from the information processing device 50 (or the database 40). The control unit 25 provides information of an emergency vehicle or the like to a driver based on the caution information on an emergency vehicle received from the information processing device 50 and calls the driver's attention. Alternatively, the control unit 25 may perform control for causing the second vehicle 20 to withdraw by automatic driving based on the caution information on an emergency vehicle received from the information processing device 50.

In this way, the traffic management system 100 can detect an emergency vehicle using the first vehicle 10 and provide caution information on the emergency vehicle to the second vehicle 20.

Figure 3:
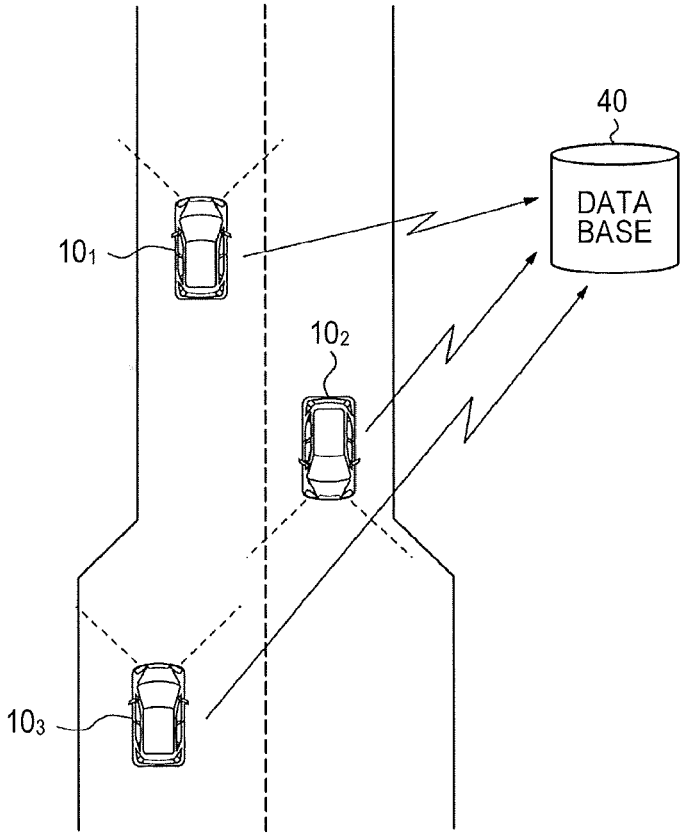
FIG. 3 is a diagram illustrating another operation (in a normal state) of the traffic management system according to the embodiment.
Figure 4:
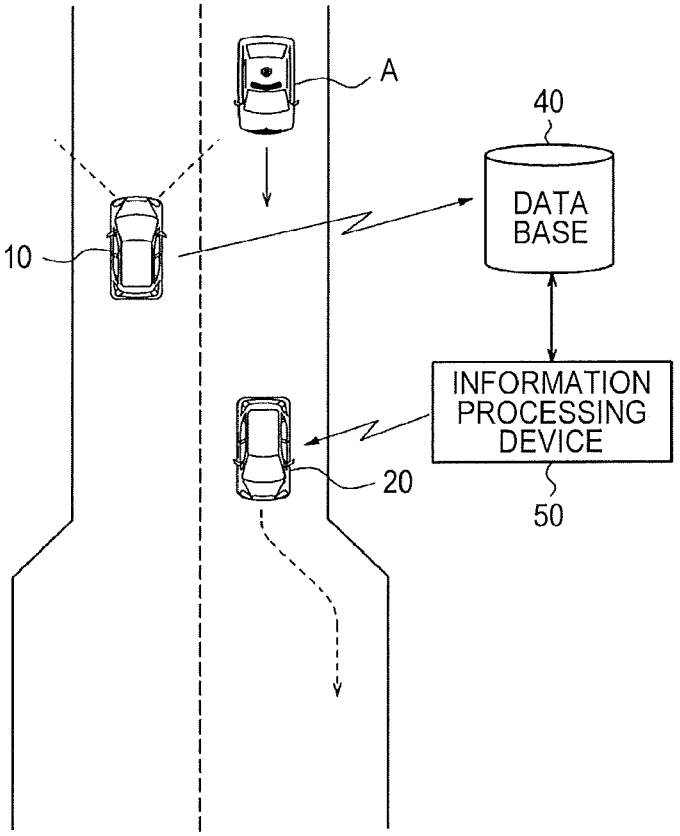
FIG. 4 is a diagram illustrating another operation (when there is an emergency vehicle) of the traffic management system according to the embodiment.

FIGS. 3 and 4 are diagrams illustrating different operations of the traffic management system 100 according to the embodiment of the disclosure. FIG. 3 illustrates the operation of the traffic management system 100 in a normal state (when no emergency vehicle is found) and FIG. 4 illustrates the operation of the traffic management system 100 when an emergency vehicle has been found.

In the normal state illustrated in FIG. 3, the first vehicle 10 ($\mathbf{10}_1$, $\mathbf{10}_2$, $\mathbf{10}_3$) transmits an image acquired by the imaging unit 11 (such as the onboard camera) along with the position information of the first vehicle 10 as an image of a road to the database 40. The vehicle 10 does not need to transmit an image of a road normally during traveling and can transmit an image of a road before and after a road state (such as a vehicle width) changes. In this way, the traffic management system 100 can efficiently collect road information. The database 40 (and the information processing device 50) analyzes an image transmitted from the first vehicles 10, analyzes states at positions on each road (such as a road width, the number of lanes, whether there is a vehicle shelter, whether there is a walkway, and a width of the walkway), adds the results of analysis as road information to map information, and stores the results.

Then, when an emergency vehicle A travels as illustrated in FIG. 4, the first vehicle 10 analyzes an image from the onboard camera, detects the emergency vehicle A, and transmits emergency vehicle information including position information to the database 40. The database 40 store the emergency vehicle information transmitted from the first vehicle 10, and the information processing device 50 reads the emergency vehicle information stored in the database 40 and predicts a traveling route of the emergency vehicle A. Prediction of a traveling route can be performed, for example, based on the position information and the traveling direction of the emergency vehicle A. The database 40 and the information processing device 50 extract a second vehicle 20 which is located on the predicted traveling route (the traveling direction) of the emergency vehicle based on the position information of the vehicles which are traveling. The information processing device 50 reads map information stored in the database 40 and acquires road information for the vicinity of the second vehicle 20 from the position information of the second vehicle 20. For example, the information processing device 50 can acquire information indicating that the road width at the current position of the second vehicle 20 is small and a sufficient traveling path for the emergency vehicle A cannot be secured even when the second vehicle withdraws to the road side, but the road width at a slightly forward position is enlarged. When it can be ascertained that there is sufficient moving time until the emergency vehicle A will reach the position of the second vehicle 20, the information processing device 50 can provide caution information including withdrawal information indicating that the second vehicle 20 can move to the position with the enlarged road width and stop on the road side to the second vehicle 20.

In this way, by storing road information in the database 40, caution information on the emergency vehicle A can be more appropriately provided to the second vehicle 20. The road information stored in the database 40 may be provided to the emergency vehicle A. The emergency vehicle A can select a traveling path suitable for traveling with a sufficient vehicle width based on the road information.

Figure 5:
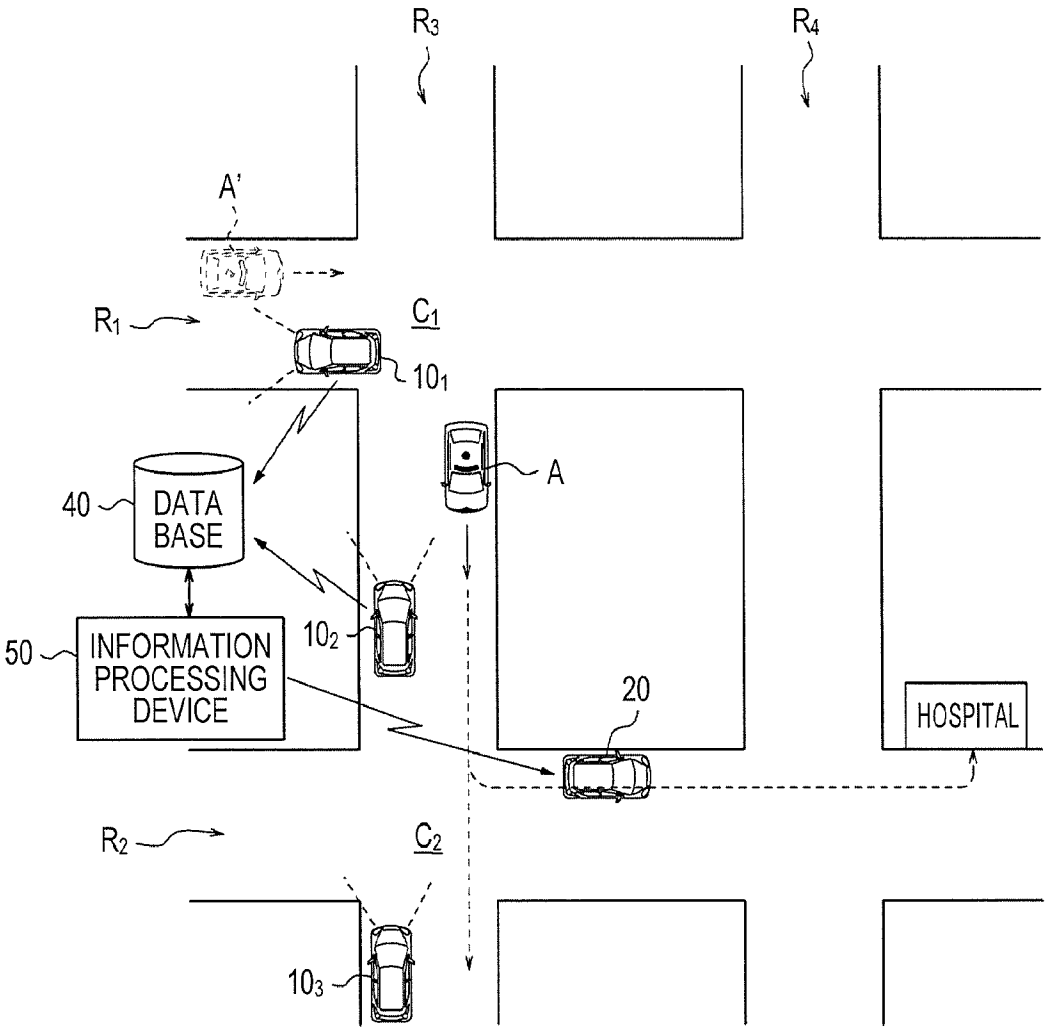
FIG. 5 is a diagram illustrating still another operation of the traffic management system according to the embodiment.

FIG. 5 is a diagram illustrating still another operation of the traffic management system 100 according to the embodiment. Prediction of a traveling route of an emergency vehicle A which is performed by the traffic management system 100 (the information processing device 50) will be described below. FIG. 5 illustrates a state in which roads R ($R_1$ to $R_4$) are provided and an emergency vehicle A is traveling in an urban area in which a hospital is located on the road $R_2$.

At a certain time point, a first vehicle $\mathbf{10}_1$ analyzes an image captured by the imaging unit 11 and detects an emergency vehicle A' (which is assumed to be an ambulance herein). Then, the first vehicle $\mathbf{10}_1$ transmits information indicating that the emergency vehicle A' which is an ambulance travels on the road $R_1$ (to the right in the drawing) along with position information of the host vehicle $\mathbf{10}_1$ as emergency vehicle information to the database 40.

At a subsequent time point, similarly, a first vehicle $\mathbf{10}_2$ analyzes an image captured by the imaging unit 11 and detects an emergency vehicle A (an ambulance). Then, the first vehicle $\mathbf{10}_2$ transmits information indicating that the emergency vehicle A which is an ambulance travels on the road $R_3$ (downward in the drawing) along with position information of the host vehicle $\mathbf{10}_2$ as emergency vehicle information to the database 40.

The information processing device 50 ascertains that the emergency vehicle A which is an ambulance travels (to the right in the drawing) on the road $R_1$ at a certain time point, then turns right at a crossing $C_1$, and travels (downward in the drawing) on the road $R_3$ at a subsequent time point by reading and analyzing two pieces of emergency vehicle information (emergency vehicle information from the first vehicles $\mathbf{10}_1$ and $\mathbf{10}_2$) stored in the database 40. In order to determine whether the emergency vehicle A' and the emergency vehicle A are the same vehicle, information for uniquely identifying a vehicle may be added to the emergency vehicle information. This becomes possible, for example, by adding image information of a vehicle to the emergency vehicle information or adding information of a number plate of a vehicle to the emergency vehicle information.

The information processing device 50 estimates that a destination of the emergency vehicle A is located on the right-lower side in the drawing with respect to the position of the first vehicle $\mathbf{10}_2$ (the position at which the emergency vehicle A has been detected) based on the traveling route (rightward on the road $R_1$ and downward on the road $R_3$) of the emergency vehicle A up to now.

Then, the information processing device 50 ascertains that a hospital is located on the side of the road $R_2$ on the side below and to the right of the position of the first vehicle $\mathbf{10}_2$ by reading map information from the database 40 and analyzing the read map information. Based on the fact that the emergency vehicle A is an ambulance and the correlation with the hospital is strong, the information processing device 50 predicts the traveling route in which the emergency vehicle (ambulance) A turns left at a crossing $C_2$, travels on the road $R_2$ (to the right on the map), and reaches the hospital.

Here, facility information such as the position of a hospital is combined with an ambulance, but a traveling route can be predicted in consideration of a correlation between the type of the emergency vehicle A and the facility information such as a combination of a patrol car and facility information such as a police station. For example, a traveling route can be predicted in consideration of correlations between a type of an emergency vehicle A and a variety of event information such as a combination of a patrol car with occurrence information of an accident event and a combination of a fire truck with fire information. Here, event information includes various events (such as an incident, an accident, and a fire) in which an emergency vehicle is involved, and event information is normally updated and recorded in the database 40.

Then, the information processing device 50 extracts the second vehicle 20 which is located on the predicted traveling route from the position information of the vehicles and transmits, for example, caution information on an emergency vehicle indicating that the emergency vehicle A is approaching. As described above, caution information may include appropriate withdrawal information based on road information.

In FIG. 5, when the first vehicle $\mathbf{10}_3$ ascertains that the emergency vehicle A travels straight on at the crossing $C_2$ thereafter, the first vehicle $\mathbf{10}_3$ transmits information indicating that the emergency vehicle A which is an ambulance travels on the road $R_3$ (downward in the drawing) along with the position information of the host vehicle $\mathbf{10}_3$ as emergency vehicle information to the database 40.

When new emergency vehicle information from the first vehicle $\mathbf{10}_3$ is acquired via the database 40, the information processing device 50 determines that the prediction of the traveling route up to now is erroneous and cancels the caution information to the second vehicle 20 (for example, a notification of canceling is transmitted). Then, the information processing device 50 predicts a new traveling route of the emergency vehicle A and transmits caution information on an emergency vehicle to another second vehicle 20 on the traveling route.

In this way, the traffic management system 100 (the information processing device 50) can normally predict a traveling route on which the emergency vehicle A will travel based on newest emergency vehicle information, and facility information and event information can be used for the prediction.

Figure 6:
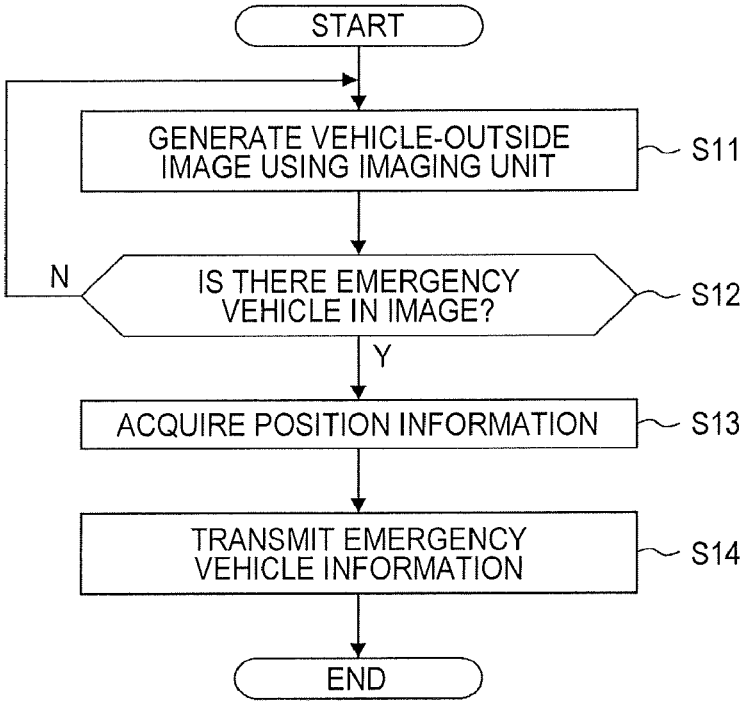
FIG. 6 is a flowchart illustrating an example of an operation of a first vehicle according to the embodiment.

An operation of transmitting emergency vehicle information in a first vehicle 10 will be described below. FIG. 6 is a flowchart illustrating an example of an operation of a first vehicle 10 according to the embodiment. The process routine which is performed by the first vehicle 10 will be sequentially described with reference to the flowchart.

Step 11 (S11): The first vehicle 10 generates (captures) a vehicle-outside (vehicle-front) image using the imaging unit 11.

Step 12 (S12): The first vehicle 10 analyzes the captured image and performs detection of an emergency vehicle by checking whether an emergency vehicle appears in the image. At the time of detection, a type of an emergency vehicle is identified. When an emergency vehicle is not detected, the operation flow returns to start. When an emergency vehicle is detected, the operation flow progresses to Step 13.

Step 13 (S13): The first vehicle 10 acquires position information of the host vehicle 10 using the position information acquiring unit 12. The position information can be handled substantially as information of a traveling position of the emergency vehicle.

Step 14 (S14): The first vehicle 10 transmits emergency vehicle information including at least the type of the emergency vehicle detected in Step 12 and the position information acquired in Step 13 to the database 40 via the communication unit 13. The emergency vehicle information may include the traveling direction of the emergency vehicle, a number for identifying the emergency vehicle or an image of the emergency vehicle, and time information at which the image has been captured. After transmission, the first vehicle 10 ends the operation flow.

Figure 7:
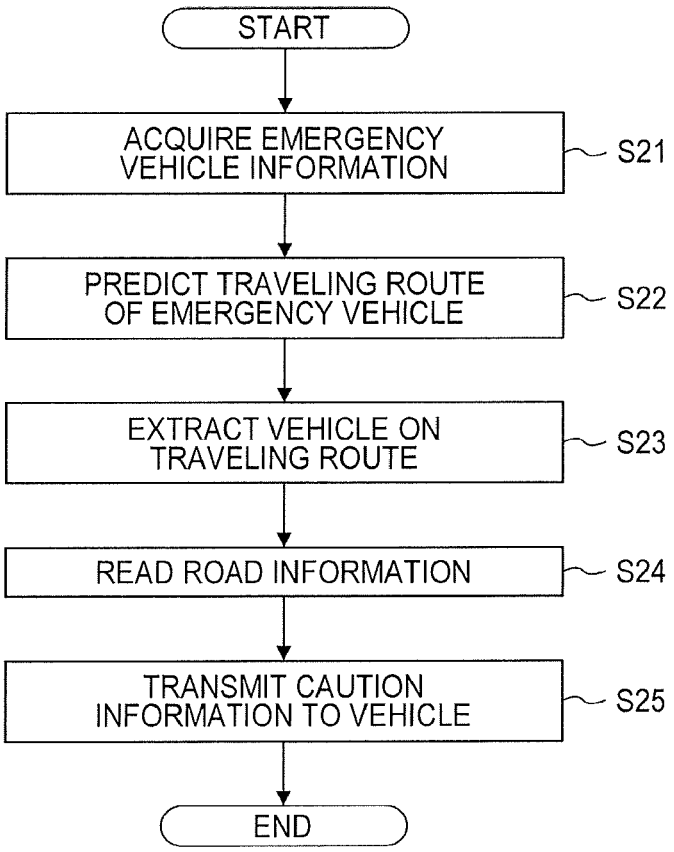
FIG. 7 is a flowchart illustrating an example of an operation of an information processing device according to the embodiment.

An operation of providing caution information in the information processing device 50 will be described below. FIG. 7 is a flowchart illustrating an example of an operation of the information processing device 50 according to the embodiment. The processes of the information processing device 50 will be sequentially described with reference to the flowchart.

Step 21 (S21): The information processing device 50 reads and acquires emergency vehicle information stored in the database 40.

Step 22 (S22): The information processing device 50 predicts a traveling route on which an emergency vehicle travels based on one piece of emergency vehicle information or in combination of a plurality of pieces of emergency vehicle information. Facility information (positions of hospitals, police stations, and the like) in map information or newest event information (occurrence of fires, accidents, and the like) can be considered for the prediction. The facility information or the event information may be read from the database 40 or may be acquired by another method. The information processing device 50 may acquire a speed of an emergency vehicle from a plurality of pieces of emergency vehicle information and predict an arrival time at each point on the traveling route on which the emergency vehicle travels.

Step 23 (S23): The information processing device 50 extracts vehicles (second vehicles) 20 that travel currently on the traveling route of the emergency vehicle which is predicted in Step 22. It is assumed that position information of the vehicles 20 are stored, for example, in the database 40.

Step 24 (S24): The information processing device 50 reads road information stored in the database 40. The road information includes the number of lanes, a road width, presence or absence of a walkway, and the like of each road based on an image from the first vehicle 10 or the like. The time at which the road information is read may be same as the time at which the position information of the vehicles 20 is read.

Step 25 (S25): The information processing device 50 notifies the second vehicles 20 extracted in Step 23 of caution information on an emergency vehicle indicating that the emergency vehicle will travel and pass within a short time. The caution information on an emergency vehicle may include information indicating that the emergency vehicle approaches and information such as the current position, the traveling direction, or the predicted traveling route of the emergency vehicle and a scheduled arrival time of the emergency vehicle. The information processing device 50 may determine to what position the second vehicles 20 can withdraw based on the position information of the second vehicles 20 and the road information, and add information on a place suitable for withdrawal or the like to the caution information on an emergency vehicle. After the second vehicles 20 have been notified of caution information, the information processing device 50 ends the operation flow.

Figure 8:
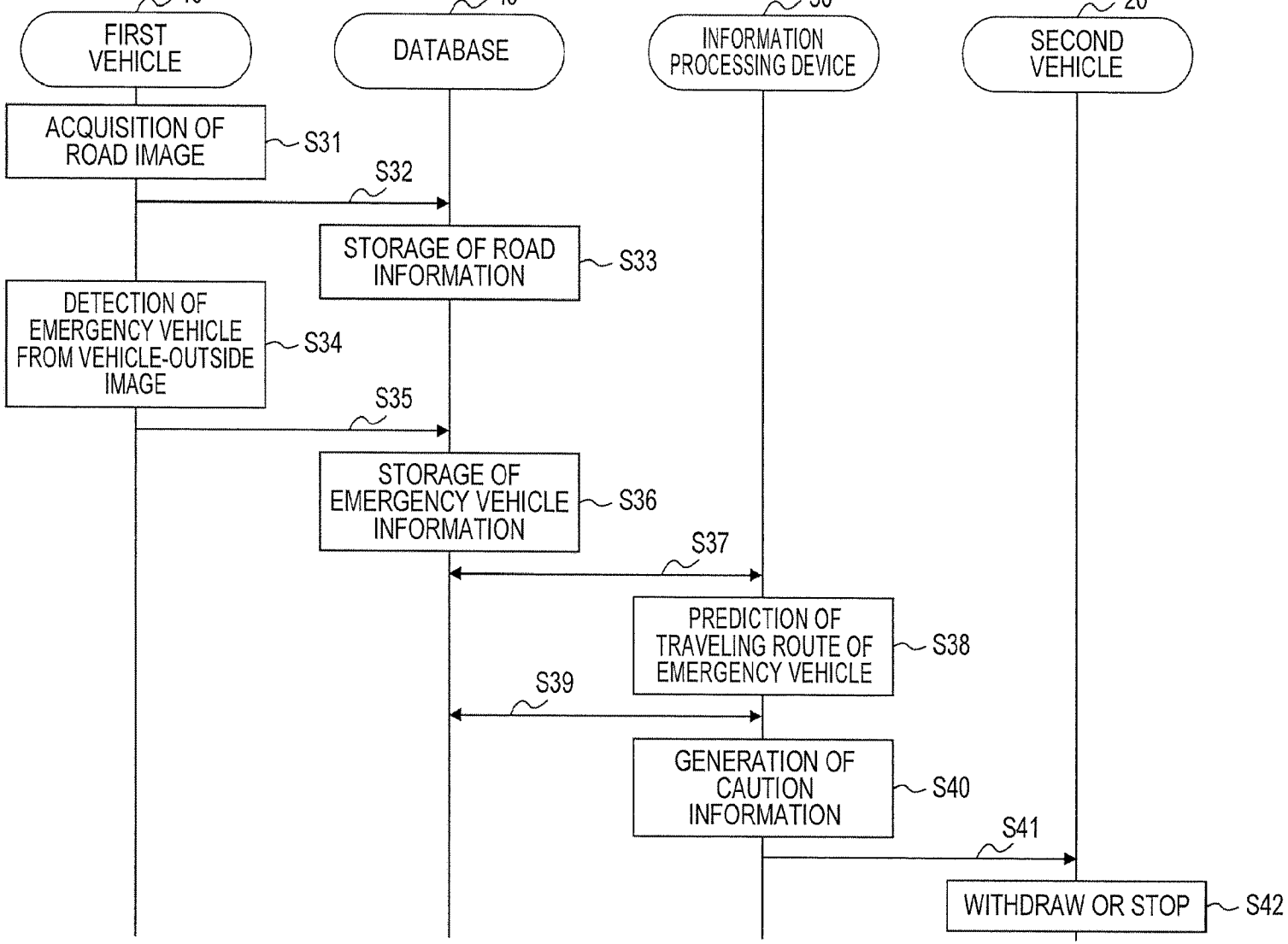
FIG. 8 is a sequence diagram illustrating an example of an overall operation of the traffic management system according to the embodiment.

FIG. 8 is a sequence diagram illustrating an example of an overall operation of the traffic management system 100 according to the embodiment.

Step 31 (S31): A first vehicle 10 captures and acquires a road image during traveling in a normal state.

Step 32 (S32): The first vehicle 10 transmits the acquired road image to the database 40.

Step 33 (S33): The database 40 stores the road image transmitted from the first vehicle 10, analyzes information such as a road width, the number of lanes of each road, presence or absence of a shelter, or the like from the road image, adds the analyzed information to the map information, and stores the road information.

Step 34 (S34): The first vehicle 10 analyzes a vehicle-outside image acquired by the imaging unit 11 and detects an emergency vehicle from the image. At the time of detection, the type and the traveling direction of the emergency vehicle can be acquired together.

Step 35 (S35): The first vehicle 10 transmits emergency vehicle information including at least the type and the traveling direction of the emergency vehicle detected in Step 34 and the position information acquired by the position information acquiring unit 12 to the database 40.

Step 36 (S36): The database 40 stores the transmitted emergency vehicle information.

Step 37 (S37): The information processing device 50 reads the stored emergency vehicle information from the database 40.

Step 38 (S38): The information processing device 50 analyzes the emergency vehicle information and predicts the traveling route on which the emergency vehicle travels. Facility information (positions of hospitals, police stations, and the like) in the map information and/or newest event information (information of incidents and accidents) can be used for the prediction.

Step 39 (S39): The information processing device 50 extracts second vehicles 20 on the traveling route of the emergency vehicle predicted in Step 38 from the position information of the vehicles in the database 40. The information processing device 50 also reads road information stored in the database 40.

Step 40 (S40): The information processing device 50 prepares caution information on an emergency vehicle indicating that the emergency vehicle is approaching based on the position information of the second vehicles 20, the current position and the traveling direction of the emergency vehicle, and the like. The caution information on an emergency vehicle may include information indicating that the emergency vehicle approaches and information such as the current position, the traveling direction, or the predicted traveling route of the emergency vehicle and a scheduled arrival time of the emergency vehicle. The information processing device 50 may determine to what position the second vehicles 20 can withdraw based on the position information of the second vehicles 20 and the road information in the vicinity thereof, and add information on a place suitable for withdrawal of the second vehicles 20 or the like to the caution information on an emergency vehicle.

Step 41 (S41): The information processing device 50 transmits the caution information on an emergency vehicle to the second vehicles 20.

Step 42 (S42): The second vehicles 20 withdraw or stop based on the caution information on an emergency vehicle transmitted from the information processing device 50. This withdrawal or stopping may be performed by drivers or may be performed by automated driving of the second vehicles 20.

As described above, according to the disclosure, even when traveling position information cannot be received from an emergency vehicle, it is possible to ascertain the position of the emergency vehicle. By predicting a traveling direction of an emergency vehicle and transmitting caution information to vehicles located on a predicted traveling route to urge preceding vehicles in the traveling direction to withdraw, it is possible to evacuate the traveling route of the emergency vehicle in advance. Accordingly, a traveling route dedicated for an emergency vehicle is not necessary and it is possible to effectively utilize roads.

In the above-mentioned embodiment, the configuration and the operation of the traffic management system 100 have been described, but the disclosure is not limited thereto and may be embodied as a method of controlling a traffic management system of identifying an emergency vehicle from an image captured by an imaging unit of a vehicle, transmitting emergency vehicle information including position information to a database, and causing the database to store the emergency vehicle information or a method of controlling a traffic management system in which an information processing unit predicts a traveling route on which an emergency vehicle travels.

A computer can be suitably used to serve as the above-mentioned information processing device 50. In this computer, a program in which processing details for embodying the functions of the information processing device 50 are described may be stored in a storage unit of the computer and the functions can be embodied by causing a CPU of the computer to read and execute the program. This program may be recorded on a computer-readable recording medium.

The above embodiment is a representative example and it is apparent to those skilled in the art that the embodiment can be subjected to various modifications and substitutions. Therefore, the disclosure should not be understood to be limited by the above-mentioned embodiment and can be subjected to various modifications or changes without departing from the appended claims. For example, a plurality of constituent blocks described above in the embodiment may be combined into one constituent block or one constituent block may be divided into a plurality of blocks.

What is claimed is:

1. A traffic management system, comprising:

a vehicle;

a database; and an information processing device, wherein the vehicle transmits emergency vehicle information including position information of the vehicle to the database when an emergency vehicle is detected from an image which is captured by an imaging device disposed on the vehicle, and wherein the database stores the emergency vehicle information transmitted from the vehicle, emergency vehicle information transmitted from a plurality of vehicles, and corresponding time information, wherein the information processing device predicts a traveling route on which the emergency vehicle is to travel based on the emergency vehicle information stored in the database, wherein a type of the emergency vehicle and at least one of facility information or event information is used to predict the traveling route on which the emergency vehicle is to travel, and the traveling route is predicted in consideration of a correlation between the type of the emergency vehicle and the facility information, or in consideration of a correlation between the type of the emergency vehicle and the event information.

2. The traffic management system according to claim 1, wherein the emergency vehicle information includes a type of the emergency vehicle and a traveling direction of the emergency vehicle in addition to the position information of the vehicle.

3. The traffic management system according to claim 1, wherein the vehicle transmits an image of a road which is captured by the imaging device to the database and the database stores road information based on the image of the road.

4. The traffic management system according to claim 1, wherein caution information on the emergency vehicle is provided to a vehicle which is traveling on the predicted traveling route.

5. The traffic management system according to claim 4, wherein the caution information on the emergency vehicle includes information of a position to which the vehicle is to withdraw.

6. The traffic management system according to claim 1, wherein a speed and a traveling direction of the emergency vehicle is estimated from the position information and the time information.

7. The traffic management system according to claim 6, wherein the time information corresponds to a time at which the vehicle generated the emergency vehicle information.

8. The traffic management system according to claim 1, wherein the event information indicates an incident, an accident, or a fire.

9. The traffic management system according to claim 1, wherein the traveling route is predicted in consideration of both the correlation between the type of the emergency vehicle and the facility information and the correlation between the type of the emergency vehicle and the event information.

10. The traffic management system according to claim 1, wherein the information processing device is configured to:

determine whether there is another vehicle at least partially blocking a portion of a road on the traveling route, determine whether there is sufficient time to move the other vehicle prior to arrival of the emergency vehicle at the portion of the road, and issue caution information indicating that the other vehicle is to be moved.

11. The traffic management system according to claim 10, wherein the information processing device determines that the other vehicle is at least partially blocking the portion of the road when, even if the other vehicle moves to a side of the portion of the road, the emergency vehicle cannot pass through the portion of the road.

12. The traffic management system according to claim 10, wherein the information processing device determines whether there is a subsequent portion of the road that is broader than the portion of the road, and issues the caution information indicating that the other vehicle is to be moved to the subsequent portion of the road.

13. A method of controlling a traffic management system including a vehicle and a database, the method comprising:

causing the vehicle to generate an image by imaging outside of the vehicle;

causing the vehicle to transmit emergency vehicle information including position information of the vehicle to the database when an emergency vehicle is detected from the image;

causing the database to store the emergency vehicle information transmitted from the vehicle, emergency vehicle information transmitted by a plurality of vehicles, and corresponding time information;

predicting, with information processing device, a traveling route on which the emergency vehicle is to travel based on the emergency vehicle information stored in the database, wherein a type of the emergency vehicle and at least one of facility information or event information is used to predict the traveling route on which the emergency vehicle is to travel, and the traveling route is predicted in consideration of a correlation between the type of the emergency vehicle and the facility information, or in consideration of a correlation between the type of the emergency vehicle and the event information.

14. A vehicle that is able to communicate with a database, the vehicle comprising:

an imaging device configured to generate an image by imaging outside of the vehicle; and circuitry configured to acquire position information of the vehicle;

communicate with the database; and transmit emergency vehicle information including the position information of the vehicle to the database via the communication unit when an emergency vehicle is detected from the image, wherein the database stores emergency vehicle information transmitted from a plurality of vehicles and corresponding time information, wherein an information processing device predicts a traveling route on which the emergency vehicle is to travel based on the emergency vehicle information stored in the database, wherein a type of the emergency vehicle and at least one of facility information or event information is used to predict the traveling route on which the emergency vehicle is to travel, and the traveling route is predicted in consideration of a correlation between the type of the emergency vehicle and the facility information, or in consideration of a correlation between the type of the emergency vehicle and the event information.

15. The vehicle according to claim 14, wherein the imaging device is a monocular camera.

16. The vehicle according to claim 14, wherein the imaging device is a stereoscopic camera.

* * * * *